US007470191B2

(12) United States Patent
Xidos et al.

(10) Patent No.: US 7,470,191 B2
(45) Date of Patent: Dec. 30, 2008

(54) RESPONSIBLE GAMING SYSTEM

(75) Inventors: John Xidos, Sydney (CA); Robert Mackenzie, Sydney (CA)

(73) Assignee: Tech Link International Entertainment Ltd. (CA)

( * ) Notice: Subject to any disclaimer, the term of this patent is extended or adjusted under 35 U.S.C. 154(b) by 500 days.

(21) Appl. No.: 10/327,402

(22) Filed: Dec. 20, 2002

(65) Prior Publication Data

US 2004/0121841 A1 Jun. 24, 2004

(51) Int. Cl.
*A63F 9/24* (2006.01)

(52) U.S. Cl. ..... 463/29

(58) Field of Classification Search ..... 463/25, 463/40, 29

See application file for complete search history.

(56) References Cited

U.S. PATENT DOCUMENTS

| | | | | |
|---|---|---|---|---|
| 5,429,361 | A * | 7/1995 | Raven et al. | 463/25 |
| 5,768,382 | A * | 6/1998 | Schneier et al. | 380/251 |
| 5,910,048 | A | 6/1999 | Feinberg | 463/25 |
| 6,010,404 | A * | 1/2000 | Walker et al. | 463/21 |
| 6,361,440 | B1 * | 3/2002 | Ogawa et al. | 463/42 |
| 6,409,594 | B1 * | 6/2002 | Rubeli | 463/20 |
| 6,629,890 | B2 * | 10/2003 | Johnson | 463/25 |
| 2002/0006214 | A1 | 1/2002 | Karlsson | 382/119 |
| 2002/0091646 | A1 * | 7/2002 | Lake et al. | 705/67 |
| 2002/0151366 | A1 * | 10/2002 | Walker et al. | 463/42 |
| 2003/0159052 | A1 * | 8/2003 | Lee et al. | 713/186 |

FOREIGN PATENT DOCUMENTS

| | | |
|---|---|---|
| WO | WO 01/40982 | 6/2001 |
| WO | WO 01/63439 | 8/2001 |
| WO | WO 01/91038 | 11/2001 |
| WO | WO 03/042830 | 5/2003 |

OTHER PUBLICATIONS

Obringer, Lee Ann, "How Swiss Bank Accounts Work", http://money.howstuffworks.com/swiss-bank-account4.htm, Accessed Jan. 12, 2007.*

* cited by examiner

*Primary Examiner*—Robert E. Pezzuto
*Assistant Examiner*—Omkar Deodhar
(74) *Attorney, Agent, or Firm*—Russo & Duckworth, LLP

(57) ABSTRACT

The invention relates generally to a gaming system distributed across both local (LAN) and wide (WAN) area networks that enables responsible gaming for its users. More specifically, the invention provides a system and method that requires users to register with the system and which thereafter enables the users to set time-based or money-based gaming limitations that will exclude them from the system if these limitations are realized. The system may be deployed across one or more jurisdictions, such as states, provinces, regions or countries.

19 Claims, 2 Drawing Sheets

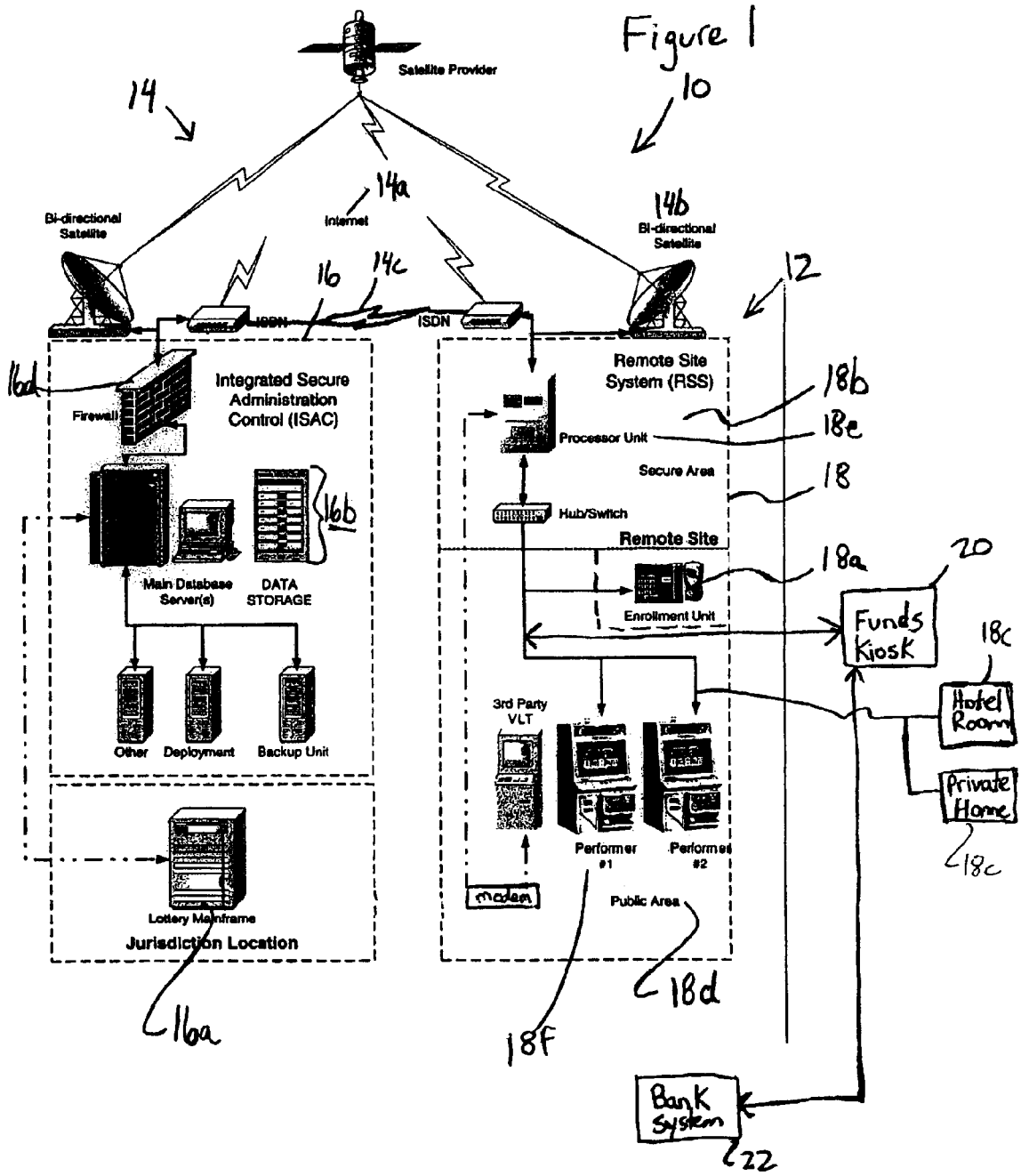
Figure 1
10
14
Satellite Provider
14a
Internet
14b
Bi-directional Satellite
Bi-directional Satellite
16
14c
ISDN
ISDN
12
16d
Integrated Secure Administration Control (ISAC)
Firewall
16b
Main Database Server(s)
DATA STORAGE
Other
Deployment
Backup Unit
Lottery Mainframe
Jurisdiction Location
16a
Remote Site System (RSS)
18b
Processor Unit
18e
Secure Area
18
Hub/Switch
Remote Site
18a
Enrollment Unit
20
Funds Kiosk
18c
Hotel Room
Private Home
18c
3rd Party VLT
Performer #1
Performer #2
Public Area
18d
18F
Bank System
22

RESPONSIBLE GAMING SYSTEM

FIELD OF THE INVENTION

The invention relates generally to a gaming system distributed across both local (LAN) and wide (WAN) area networks that enables responsible gaming for its users. More specifically, the invention provides a system and method that requires users to register with the system and which thereafter enables the users to set time-based or money-based gaming limitations that will exclude them from the system if these limitations are realized. The system may be deployed across one or more jurisdictions, such as states, provinces, regions or countries.

BACKGROUND OF THE INVENTION

Electronic gaming systems are well known. In particular, video lottery terminals (VLTs) and the like are widely distributed in many jurisdictions and are located in many different establishments. The operation of VLTs is regulated, with government jurisdictions controlling and monitoring the deployment and operation of VLTs within the particular jourisdiction. Government controls are generally required to ensure that the operation of the VLT machines is in accordance with jurisdictional law and more specifically to ensure that revenues derived from the VLTs are properly tracked and that the machines and their software cannot be tampered with.

VLTs are a significant source of income to most governments. As a result, there continues to be a tremendous interest by governments in protecting this source of revenue. However, while providing an income source, there is often a social cost associated with gaming in general. While the majority of gamblers using VLTs or casinos use gambling strictly as a casual form of entertainment and can afford the time spent gambling and gambling losses, there are a significant number of gamblers that develop addictive or otherwise problematic behaviour from excessive time spent gambling and/or gambling losses. Excessive time spent gambling and excessive gambling losses over both short and long term time frames may directly or indirectly lead to many different social problems. Gambling losses may be realised during short term gambling stints or progressively over a longer period of time.

As a result, governments are often criticized for their role in promoting and regulating gambling because of the likelihood of some individuals developing gambling problems and the potential for various downstream social problems developing in spite of the fact that the relative number of problem gamblers is low in comparison to the total number of gamblers.

Thus, from the government or regulators perspective, most jurisdictions do not wish to forgo the revenues derived from gambling but rather wish to minimize the number of problem gamblers and the negative social effects that problem gamblers may cause. In the past, casinos and bar establishments having gaming and gaming machines expend considerable resources monitoring and controlling individuals that may be considered problem gamblers. These efforts generally focus on those individuals who display behaviour that may be disruptive to other gambling patrons. Thus, while certain individuals can become aware to personnel at individual establishments and be excluded from that establishment, this monitoring activity is highly subjective and may only be effective for certain types of physical behaviour and only after the problem has manifested itself.

For some individuals, problem gambling behaviour does not manifest itself in any outwardly detectable manner at the establishment. For these individuals, problem behaviour may be directly related to the time-spent gambling or to the amount of money spent during gambling. For these individuals, problem behaviour may manifest itself indirectly and away from the establishment.

Other problems that may exist include underage play where minors access VLTs without being properly screened by the establishment.

As a result, there has been a need for a system that enables an effective compromise between the revenue interests of the jurisdiction and which also enables some gamblers to be excluded from gaming in an effective, yet unobtrusive manner.

In particular, there has been a need for a system that enables either self-imposed restrictions or restrictions imposed upon gamblers by regulators. In other words, there has been a need for a system which allows both government regulators and gamblers to set time-limits and money losses over both short and longer time frames including the ability to set maximum day, weekly and monthly times spent gambling and maximum losses over similar time periods. Further still, there is a need for a system allowing gamblers to immediately self-exclude themselves from the system if desired.

Still further, there has been a need for a system that includes an efficient accounting system to enable users to effectively manage funds while gaming.

SUMMARY OF THE INVENTION

In accordance with the invention, there is provided a gaming system comprising a central administrative system (CAS) for receiving and verifying the uniqueness of biometric information received from a user with a central database storing coded biometric data from multiple users; at least one biometric enrolment system operatively connected to the CAS for receiving and coding biometric information from a user at a remote location for submission to the CAS, the biometric enrolment system also for receiving verification from the CAS of the uniqueness of a user and for providing the user with a registration ID; and at least one gaming device operatively connected to the CAS for providing gaming to a user, the gaming device operative to a user only upon user entry of the registration ID.

The gaming system may also include a self-exclusion system enabling a user to selectively set a time-based limit or a money-based gaming limit for use of the system. The self-exclusion system allows a user to selectively set a time-based limit for the amount of time spent using the gaming system and/or a money-based limit that limits the loss of a user over a specified time. The self-exclusion system may include an immediate self-exclusion function accessible to a user from a gaming device.

In one embodiment, the CAS maintains financial account information for each user of the system that is preferably accessible to a user in real-time from a gaming device.

In a further embodiment, the CAS includes a biometric information database including the coded biometric information from users and preferably wherein the biometric enrolment system includes at least one enrolment unit having a biometric scanning device for receiving biometric data from a user.

In various embodiments of the system, the gaming system includes a plurality of remote locations each having individual biometric enrolment systems and/or a funds kiosk enabling a user to credit money to their system account or debit money from their system account.

In one deployment of the gaming system at least one gaming device is in a non-secure location.

In further embodiments, the CAS monitors credits and debits to the user's system account during gaming and wherein each gaming device supports any one of or a combination of cash-based or electronic-based transactions. Furthermore, each gaming device may support any one of or a combination of phone cards, debit cards, credit cards, smart cards or bar-coded, numbered or magnetic stripe vouchers for providing money credits to a user's system account.

In another embodiment of the invention, a method of enrolling users with a gaming system is provided comprising the steps of: obtaining biometric information from a user; submitting the biometric information to a database storing biometric information data from multiple users; verifying the uniqueness of the biometric information; and issuing the user with a gaming system registration ID if the biometric information is verified as unique.

Other embodiments of the method enable biometric information obtained from a user to be coded prior to submission to the database and the verifying and issuing steps relate to coded biometric information.

In another embodiment, biometric information from a user is destroyed before, during or after issuing the user with a gaming system registration ID.

In another embodiment, the method includes the step of verifying photo identification of the user by gaming system personnel prior to obtaining biometric information from the user.

In another embodiment, the invention provides a method of verifying a user as a registered user of a gaming system comprising the steps of: requesting a user enter a gaming system registration ID into a gaming device; submitting the gaming system registration ID to a database storing registration information from previously registered users; and, granting access to gaming devices if the database confirms that the gaming system registered ID entered by a user represents a previously registered user.

In yet another embodiment, the invention provides a method of restricting access to a registered user of a gaming system having a self-exclusion system comprising the steps of: monitoring self-imposed limits set by the registered user with respect to the amount of money won or lost by the registered user during gaming to determine a real-time position of the user with respect to money won or lost or total time spent gaming over a specified time period; comparing the real-time position against the self-imposed limits; determining if a self-imposed limit has been exceeded and; preventing further gaming by the user in the event that a self-imposed has been exceeded.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIG. 1 is a network diagram of a gaming system in accordance with the invention; and, FIG. 2 is a representative screen of a user imposed money limit and account summary.

DETAILED DESCRIPTION

Figure 2:
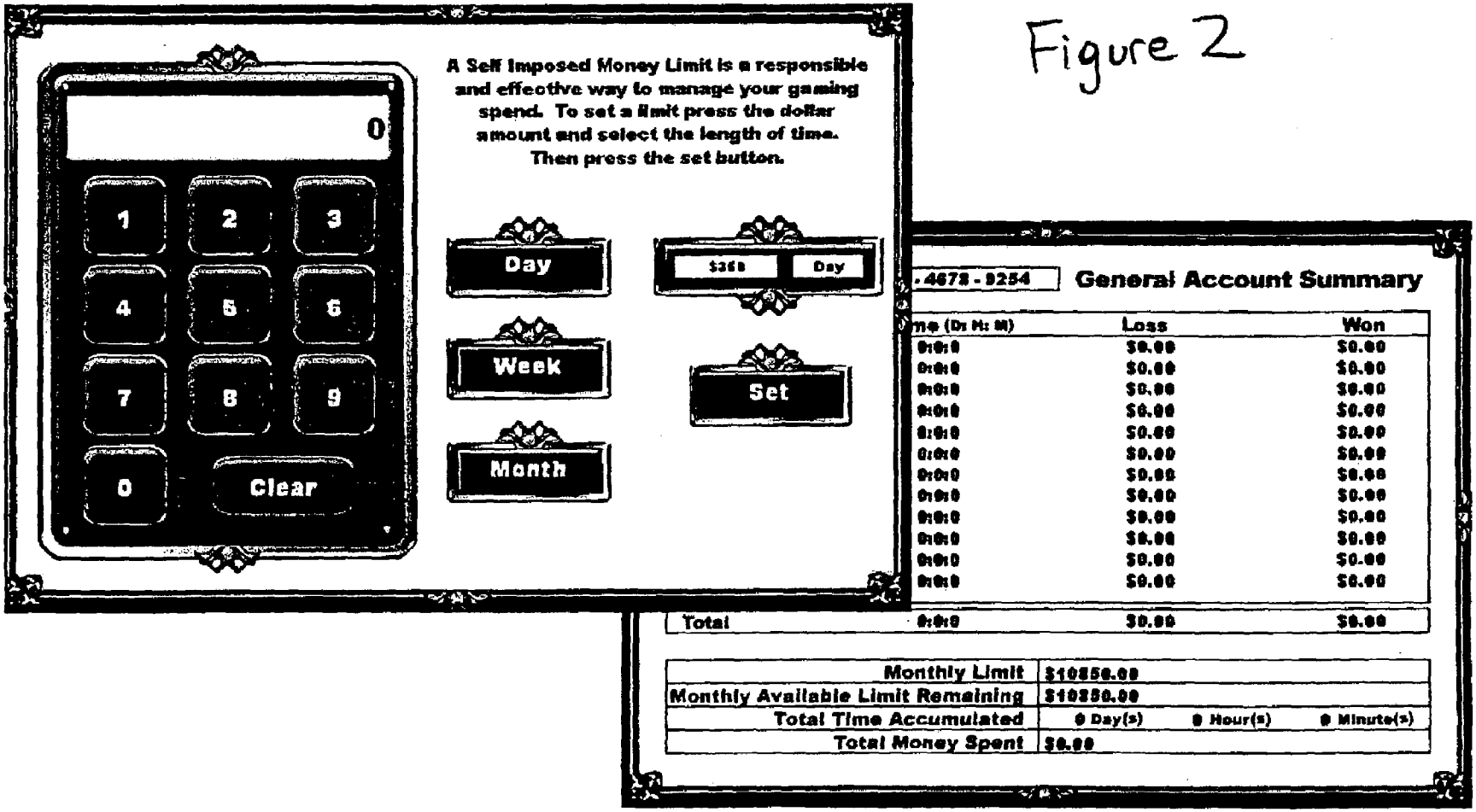

With reference to the Figures, the invention provides a gaming system 10 distributed across both local (LAN) 12 and wide (WAN) 14 area networks enabling responsible gaming for users of the system. More specifically, the invention provides a system and method requiring users to register with the system and which thereafter enables users to set time-based or money-based gaming limitations that will exclude them from the system if these limitations are realized. The system may be deployed across one or more jurisdictions, such as states, provinces, regions, or countries.

Overview

With reference to FIG. 1, the system 10 generally includes a distributed gaming system deployed across both a wide area network 14 and at least one local area network 12. The gaming system includes a central administration system (CAS) 16 at a central location and at least one remote site system 18 having an enrolment unit 18*a* and at least one gaming device 18*f*. The CAS and the remote sites are connected via appropriate wide area network systems such as the internet 14*a*, satellite 14*b* or direct wireline 14*c* connections through the phone network.

Central Administration System 16

The central administration system (CAS) 16 generally has the administrative functions required by the jurisdiction for compliance with the requirements of the jurisdiction with respect to gaming security, fair play, accounting as well as other administrative functions including user registration access to the system and account management functions.

As shown in FIG. 1, the central administration system 16 will typically include a lottery mainframe 16*a* operatively connected to a main database server(s) and data storage devices. The CAS is connected to the WAN through a firewall 16*d*.

Remote Site 18

The remote site system(s) (RSS) 18 will each typically include a local area network having a secure area 18*b* and one or more unsecure 18*c* or semi-secure areas 18*d*.

A secure area 18*b* generally refers to an area that is accessible by gaming system personnel only and would include the areas where a physical barrier prevents access by the public. The secure area 18*b* generally includes a LAN processor unit 18*e* operatively connected to one or more gaming devices 18*f* and one or more enrolment units 18*a*. The LAN is operatively connected to the CAS 16 through a WAN.

A semi-secure location 18*d* generally refers to a location where gaming can be monitored by personnel, cameras, or other security means or areas that would otherwise be considered off-limits to the public. Such areas would include areas such as bars or casinos having gaming devices such as video lottery terminals (VLTs) 18*f* where system personnel are continuously or semi-continuously monitoring users. Other semi-secure locations may also include locations within buildings such as the areas behind service counters.

An unsecure location 18*c* refers to a location where monitoring by gaming personnel is not possible. For example, an unsecure location would include remote computer systems within a user's home or gaming devices within hotel rooms where the user is in complete privacy.

The RSS 18 generally has the functionality to enroll users with the system and to provide gaming to the users through the gaming devices 18*f*.

The gaming devices 18*f* will include an access system that requires a user to log onto the system before permitting play on a particular device 18*f* as will be explained in greater detail below.

Enrolment System

The enrolment system generally has the functionality of registering users with the gaming system 10. The enrolment system ensures that each user registering with the system is a legitimate user meeting the requirements of the jurisdiction for registration and to ensure that the individual cannot be enrolled as a separate user at another time or location.

The enrolment system requires a user to register with the system prior to being able to access the gaming devices. Subsequent to this enrollment, the system requires that the user log onto a gaming device each time the user wishes to access the system. Enrolment with the system generally follows the following procedure.

At an enrolment location, that is a location monitored by gaming system personnel in a secure or semi-secure location, a user wishing to register with the system presents themselves to gaming system personnel. The enrolment location has an enrolment device 18*a*.

Initially, gaming system personnel will verify that the user is entitled to register with the system by requesting suitable identification from the user that is used to i) verify that the user is who they present themselves to be; ii) that they are not underage and/or iii) meet specific requirements of the jurisdiction with respect to residency or non-residency. In this regard, the user will preferably present an acceptable form of photo-identification such as a passport or driver's license to gaming system personnel for review. Upon being satisfied that the user is potentially a legitimate user (ie that they are the person on the photo-identification), the gaming system personnel will request biometric identification from the user in order to confirm that the user has not previously registered with the system. Biometric identification may be provided through an appropriate biometric identification system (BIS) such as a finger print scanning device, retinal scanning device or a voice scanning device as may be selected by the jurisdiction. The BIS is operatively connected to the enrolment unit 18*a* or forms an integrated part of the enrolment unit 18*a*.

The user will then provide the biometric data to the BIS wherein the biometric data is preferably coded to a unique biometric identification number (BIN) representing the biometric information of that user. For example, the coding process may yield a 32 bit number (or higher) representing the fingerprint map of a user at a resolution that prevents or minimizes the risk of a potential conflict with another person on the planet. The coding process of the BIS is consistent across multiple BISs in all enrolment devices to ensure that a user attempting to register at a different BIS will yield an identical or substantially identical BIN at any BIS in the jurisdiction.

The BISs may be off-the-shelf products including biometnrc devices from companies such as Bio-Key, Bioscript, Sagem Morpho, Identix, Imagis, Viisage, Security Biometrics, Saflink, Iris Recognition Technology, NRC, Authentec, Veridicom, Bio Vector ID, Bergdata AG or I/O Software.

The enrolment unit 18*a* then submits the BIN to a central BIN database of the CAS to determine if a similar BIN has been registered with the system. If the CAS confirms that the BIN is unique and the user meets all other registration criteria, the BIN is entered into the central BIN database. In a preferred embodiment, the BIN is used as the sole identifier of a user of the system and, as such, does not require any additional information including personal information such as the person's name, address, age, etc. to enable registration and subsequent access to the system. While in other embodiments, additional information may be entered into the system, it is preferred that no personal information is maintained in the system.

As a result, in this preferred embodiment, the user can be assured that there is no linking between their name and the biometric information and, hence, the user can be assured of their privacy. Furthermore, any gaming restrictions as will be explained below with respect to gaming are associated only with the BIN and not to identify information about that person.

After registration, the BIN, preferably in conjunction with a secret personal identification number (PIN), enables access to the system. Due to the length of the BIN, the BIN may be linked to another and shorter user ID number that is used to access the system.

After receiving confirmation that the BIN has not been previously registered with the system, the gaming personnel will then complete the registration of the user. Registration is completed in accordance with the specific functionality of the system and preferably by issuing specific user access material, such as an access card. The type of access card issued may be particular to other aspects of the system functionality. In particular, system functionality may be varied with respect to the handling and tracking of funds within the system and thus different types of cards may be issued to accommodate the specific characteristics of handling funds.

For example, in one embodiment, the gaming personnel will issue the user with a user ID and PIN number. The user ID may be printed or held on a card (for example, a simple printed, proximity, magnetic swipe card or smart card) and the PIN number selected and retained by the user in a manner that is known. In this embodiment, a user, upon receiving a card (which has been issued only after a BIN has been assigned) wishing to access a gaming machine enters the user ID into the gaming device (through manual keypad entry, or locating, swiping or insertion of the card) and manually enters the PIN into the gaming device 18*f*. Upon entry and validation of the PIN, the central system verifies that no restrictions (explained below) are associated with that registration number and allows the user to operate the gaming device. If a gaming restriction is in place, the user is notified that gaming is denied in view of a restriction.

In the case where the system does not enable electronic funds handling, the user games with cash (or tokens) and the system monitors the amount of cash entered into a gaming device and paid from the gaming device thus enabling an electronic record associated with that registration number to be maintained.

In the case where the system does enable electronic funds handling, upon entry of the user ID and PIN, the user may access an electronic account of funds, and be able to game without using cash. Electronic account of funds are preferably secured on a central server but may also be implemented using smart card technology.

Finally, with respect to registration and depending on the jurisdictional requirements, the user may also be required to execute an agreement with the gaming system jurisdiction with respect to the terms and conditions of the use of the system. As most individuals will wish that no biometric information will form any part of a database accessible to any party, the gaming system jurisdiction will preferably verify to the user that biometric data obtained is used strictly for enrolment with the system and that the biometric data is destroyed after registration. That is, the biometric information will only be used to created a coded number and that the biometric data per se, is destroyed and is not stored anywhere. In addition, it is also preferred that the jurisdiction confirm that no information with respect to the user's use of the system for gaming will be shared with any government or agency including the police.

Account Funds

As indicated above, it is preferred that the system enables both cash and electronic funds transactions to be monitored. Different gaming machines may enable cash-based transactions only or electronic transactions only or a combination of both. In this regard, the RSS may also include funds kiosks 20 that enable a user to credit or cash-out their account through the use of debit cards, credit cards, cash and other credit/debit systems.

In different embodiments of the system, account credits and debits may be handled in different ways.

1. Cash—The user may game with cash and receive cash directly from the gaming device. The system monitors the amount of cash entered into the machine and paid out to determine any restrictions.

2. Electronic Account—As indicated above, the user may credit their electronic account at specialized kiosks 20 or with gaming system personnel. Specialized kiosks may be directly linked to a user's bank accounts through the banking system 22 to enable the transfer of funds to the electronic account. In other embodiments, gaming system personnel may receive and process cash, debit cards, credit cards and/or smart cards to credit a user's account from an appropriate terminal. Other technologies used in connection with cash credits may be utilized. Such technologies may involve cards, such as phone cards or variations thereof, including barcoded, numbered or magnetic stripe vouchers.

Cash paid out to a user may be from the kiosks 20. Kiosks may be automated or require operation by gaming system personnel.

3. Smart Card—The user may credit and/or debit cash to a smart card for use with the system.

Further Access Security

In a further embodiment of the system, access to gaming will further require that biometric identification be provided in addition to a registration number to gain access to the gaming devices 18*f*, 18*c*. In this case, the user may enter their registration number and then be requested to provide biometric information at the gaming device where each gaming device is provided with a BIS. For example, upon receiving prompts from the gaming device, the user would be required to place a finger in a finger print reader to obtain a finger print scan for coding and comparison against the BIN at the CAS. If the BIN obtained from the gaming location is not identical to the unique biometric identification number, access to the gaming system is denied. The system will preferably permit a limited number of re-tries in the event of a non-identical reading. Upon fully accessing the system, the user is then free to game.

In one embodiment, the system may also periodically or randomly prompt the user to re-enter their biometric information into the system to confirm that the user actually gaming is the person who accessed the system. This procedure will effectively prevent one user allowing another user access to the first user's account. The system may also require that a user provide biometric information at the time they are adding money to or cashing money out an account.

In another embodiment, the enrolment system tracks the location of the user. For example, in a deployment where the gaming system is distributed across multiple jurisdictions, individual jurisdictions may require that a user access the system only when the user is in that particular jurisdiction. In this embodiment, at the time of registration, a jurisdictional code may be included or associated with the user's account with the functionality that if the user has registered with one jurisdiction, they may be prevented from accessing the system in another jurisdiction based on the jurisdictional code associated with that account. Alternatively, in another embodiment, the user may be able to access the system to game in another jurisdiction but will only be able to add money to their account or cash-out their account when present in their home jurisdiction.

Similarly, in an embodiment wherein the system supports internet gambling from non-secure locations 18*c*, the system may also prevent a user from adding money to their account or cashing-out their account when outside their home jurisdiction. For example, a user may register to game in a home jurisdiction, add money to their account in the home jurisdiction and then travel to a second jurisdiction where gaming laws do not permit the actual exchange of funds from gaming. In this situation, a user may game using their existing account funds whilst in the second jurisdiction but in the event of gaming wins or gaming losses, the user would be unable to either receive money or add money to their account without returning to the home jurisdiction.

Self-Imposed Access Restrictions

Once a user has accessed the system, the system thereafter allows the user to self-impose restrictions. Thereafter, if a restriction is encountered either upon logging on to a gaming device or while gaming after having logged into a gaming device, the user is advised of the restriction and the system prohibits further gaming until the restriction expires. Several embodiments of restrictions are described below.

Generally, restrictions may be time-based or money-based.

Time-Based Restrictions

A time-based restriction enables the user to self-impose the amount of time that can be spent gaming over a particular period of time. That is, the system allows the user to enter one or more specific time values such as daily, weekly, monthly and annual time values whereby if any one of the time-values is reached, the user is immediately prevented from any further gaming. For example, a user may wish to restrict the amount of time spent gaming per day to a maximum of 2 hours/day in addition to restricting the total amount of time spent gaming per month to a maximum of 20 hours/month. Thus, in the event that either of these restrictions are met, the user is prevented from further gaming. The system maintains an internal timer that logs the time spent gaming. In one embodiment of the system, the system displays a clock (either countdown or count-up) that logs the total elapsed time for a displayed time period.

Money Restriction

The money-based restrictions are similar to the time-spent restrictions allowing the user to select a maximum gaming spend for a given period of time. In this case, the user is asked to set a maximum spend value for one or more specific times such as a day, week or month. For example, a user may set that the maximum gaming spend for a day is $150 and that the maximum gaming spend for a week is $200 and for a month is $300. As for the time-spent restriction, in the event that any of these restrictions are met, the user is prevented from further gaming until the expiry of that restriction. This embodiment requires that the system properly tracks money lost and gained by each user.

The self-imposed time and money restrictions are accessible to the user while gaming preferably as a touch screen option selectable at any time after gaining access to the system. Upon selecting the restrictions option, a screen is displayed with input buttons to select whether a time-based or money-based restriction. Selection of either a time-based or money-based restriction will present a further screen allowing number and date selections to enter the appropriate money, time and date information. A further input button enables the user to confirm the selection. A representation screen is shown in FIG. 2.

It is preferred that once set, the restrictions cannot be altered for any reason until the expiry of the restriction.

Time-based and money-based restrictions are stored within the central database and are linked to the user's unique BIN. As a result, the restrictions are accessible to all gambling devices on the network thereby preventing a user from exceeding a limit on one machine and then moving to a different machine in a different location in an attempt to overcome the restriction.

In a further embodiment, the system also provides an account summary in spreadsheet format detailing the time-spent and money lost/gain values for each gaming session. In addition, information such as any set or realized restrictions may also be displayed.

In a further embodiment, the system enables a user to immediately self-restrict themselves from the system by accessing and quickly over-riding any restrictions that have not been reached. For example, a user may wish to immediately self-exclude themselves if they have realized a profit and want to prevent themselves from risking that profit with further gaming or, alternatively, if they have lost an amount of money.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A responsible gaming system for enrolling users with a gaming network and ensuring that all users are uniquely and anonymously registered users prior to enabling each user access to a gaming device, the responsible gaming system also for monitoring gaming restrictions associated with a user, the responsible gaming system comprising:

a central administrative system (CAS) for receiving and verifying the uniqueness of biometric information received from a user, the CAS having a central database for storing coded biometric data from multiple users wherein personal identifying information including any one of or a combination of the user name, address, or age is not associated with the coded biometric information of a user on the central database and wherein no personal identifying information can be determined from the coded biometric information, the CAS also for monitoring gaming restrictions associated with a user;

at least one biometric enrolment system operatively connected to the CAS for receiving and coding biometric information from a user at a remote location for submission to the CAS, the biometric system requiring all users to register with the gaming system prior to being able to access at least one gaming device and said biometric enrolment system also being arranged for receiving verification from the CAS of the uniqueness of the biometric data of a user and providing a gaming system registration ID if the biometric information is verified as unique;

at least one gaming device operatively connected to the CAS for providing gaming to a user, the gaming device operative to a user only upon user entry of the registration ID and verification from the CAS that no gaming restrictions are associated with the user registration ID; and, a system account operatively connected to the CAS having financial account information for each user of the system relating to the user's gaming activity and wherein a user's financial account information is accessible to a user from a gaming device.

2. A responsible gaming system as in claim 1 wherein the CAS includes a self-exclusion system enabling a user to selectively set a time-based limit or a money-based gaming limit for use of the system.

3. A responsible gaming system as in claim 2 wherein the self-exclusion system allows a user to selectively set a time-based limit for the amount of time spent using the gaming system and the time-based limit can be selected from any one of or a combination of discrete time values including a day, week, month, year or scheduled time.

4. A responsible gaming system as in claim 2 wherein the self-exclusion system allows a user to selectively set a money-based limit for any one of or a combination of discrete time values including a day, week, month or year.

5. A responsible gaming system as in claim 2 wherein the self-exclusion system includes an immediate self-exclusion function accessible to a user from a gaming device.

6. A responsible gaming system as in claim 1 wherein the at least gaming device is selected from any one of or a combination of a video lottery terminal, live casino games or home or hotel computer systems supporting gaming.

7. A responsible gaming system as in claim 1 wherein the CAS maintains a real-time financial position for each user of the system.

8. A responsible gaming system as in claim 1 wherein the biometric enrolment system includes at least one enrolment unit having a biometric scanning device for receiving biometric data from a user.

9. A responsible gaming system as in claim 1 wherein the gaming system includes a plurality of remote locations each having individual biometric enrolment systems.

10. A responsible gaming system as in claim 9 wherein a remote location further includes at least one funds kiosk enabling a user to credit money to their system account or debit money from their system account.

11. A responsible gaming system as in claim 1 wherein the gaming system is deployed across both a wide area network (WAN) and at least one local area network (LAN).

12. A responsible gaming system as in claim 11 wherein the gaming system is deployed across multiple jurisdictions with separate LANs in each jurisdiction.

13. A responsible gaming system as in claim 1 wherein the CAS is operatively connected to the at least one gaming device over the internet.

14. A responsible gaming system as in claim 1 wherein at least one gaming device is in a non-secure location.

15. A responsible gaming system as in claim 1 wherein the registration ID includes a personal identification number (PIN).

16. A responsible gaming system as in claim 1 wherein the CAS monitors credits and debits to the user's system account during gaming and wherein each gaming device supports any one of or a combination of cash-based or electronic-based transactions.

17. A responsible gaming system as in claim 16 wherein each gaming device supports any one of or a combination of phone cards, debit cards, credit cards, smart cards or barcoded, numbered or magnetic stripe vouchers for providing money credits to a user's system account.

18. A method of anonymously enrolling users with a responsible gaming system for the purpose of granting or denying access to gaming devices within the responsible gaming system comprising the steps of:

obtaining biometric information from a user;

submitting the biometric information to a database storing biometric information data from multiple users;

verifying the uniqueness of a player on the basis of the biometric information;

storing the biometric information on the database without personal identifying information including any one of or a combination of the user name, address, or age of a user being associated with the biometric information on the database and wherein no personal identifying information can be determined from the coded biometric information;

issuing the user with a gaming system registration ID if the biometric information is verified as unique wherein the registration ID is used to grant or deny access to gaming devices within the responsible gaming system; and monitoring gaming restrictions associated with a user and granting or denying access to gaming devices based on the gaming restrictions.

19. A method as in claim 18 wherein the biometric information obtained from a user is coded prior to submission to the database and the verifying and issuing steps relate to coded biometric information.

* * * * *